US006746260B2

(12) United States Patent
Chudkosky et al.

(10) Patent No.: US 6,746,260 B2
(45) Date of Patent: Jun. 8, 2004

(54) UNIVERSAL LAMP HOLDER ASSEMBLY FOR AN APPLIANCE

(75) Inventors: Frank N. Chudkosky, Alexis, IL (US); Thomas J. Bender, Fort Wayne, IN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/207,806

(22) Filed: Jul. 31, 2002

(65) Prior Publication Data

US 2004/0023539 A1 Feb. 5, 2004

(51) Int. Cl.[7] ..... H01R 33/02
(52) U.S. Cl. ..... 439/236; 362/92; 362/226
(58) Field of Search ..... 439/236; 362/92, 362/226

(56) References Cited

U.S. PATENT DOCUMENTS

| | | | |
|---|---|---|---|
| 1,172,953 | A | 2/1916 | Dempster |
| 1,640,434 | A | 8/1927 | Weston |
| 4,928,032 | A | 5/1990 | Skoch et al. |
| 5,408,392 | A | 4/1995 | Hughes |
| 5,411,411 | A | 5/1995 | Ogawa et al. |
| 5,580,158 | A | 12/1996 | Aubrey et al. |
| 5,700,154 | A | 12/1997 | Geary |
| 5,870,900 | A | 2/1999 | Mohebbi et al. |
| 5,901,562 | A | 5/1999 | Tunzi et al. |
| 5,964,615 | A | 10/1999 | Endres |
| 5,989,070 | A | 11/1999 | Al-Turki |
| 6,036,522 | A | 3/2000 | Holzer |
| 6,080,019 | A | 6/2000 | Coushaine |
| 6,083,050 | A | 7/2000 | Hsu |
| 6,190,191 | B1 | 2/2001 | Pasternak |

FOREIGN PATENT DOCUMENTS

| | | |
|---|---|---|
| FR | 2612003 | 9/1988 |
| FR | 2674695 | 10/1992 |
| GB | 2331405 | 5/1999 |

*Primary Examiner*—Renee S. Luebke
*Assistant Examiner*—Ann M McCamey
(74) *Attorney, Agent, or Firm*—Diederiks & Whitelaw, PLC

(57) ABSTRACT

An appliance lamp holder assembly in accordance with the invention directly accommodates the use of various lighting units, either directly or through the use of one or more adapter bases, in a multitude of international applications. More specifically, the universal lamp holder assembly of the invention preferably includes an adapter base which can take the form of a housing, snap-connector ring or the like. A lamp holder member is then inserted into the adapter base and firmly locked in place. With this arrangement, a single lamp holder member can be employed in illuminating various zones in the appliance or different lamp holder members can be employed with universal adapter bases to cover both domestic and a multitude of international hi-volt (e.g. 220–240V, 50/60 Hz) and 115 volt applications.

40 Claims, 7 Drawing Sheets

UNIVERSAL LAMP HOLDER ASSEMBLY FOR AN APPLIANCE

BACKGROUND OF THE INVENTION

1. Field of the Invention

The present invention pertains to the art of appliances and, more particularly, to a lamp holder assembly which can be readily adapted for use in connection with variously configured domestic and international lighting arrangements in appliances.

2. Discussion of the Prior Art

In major household appliances, lighting units are often employed to illuminate select areas for improved access. For instance, lights are typically incorporated into refrigerators in order to enable select compartment zones to be lit to enhance the visibility of stored food items. Correspondingly, lighting arrangements are also found in other appliances, including clothes dryers.

In today's marketplace, domestically manufactured appliances can be shipped all over the world. It is also known to manufacture commonly designed appliances in different regions of the world. In either case, the lighting arrangements incorporated into the various appliances must be specifically adapted to the particular electrical requirements in the region(s) where the appliances are to be sold. More particularly, there exists a fairly large range of voltage variations and lamp-type requirements between different countries which must be accounted for when producing appliances for sale.

Based on the above, it is commonplace to incorporate, in the manufacture of requisite appliances, lamp holder units which are specifically designed for the particular environment of use. Unfortunately, given the rather large range of voltage and lamp-type variations, significant incremental costs are incurred in connection with manufacturing dedicated appliances in this fashion. Based on at least these reasons, there exists a need for a lamp holder assembly which can be employed in the manufacture of an appliance to establish a substantially universal connection that will accommodate a wide range of lamp modules employed in various countries.

SUMMARY OF THE INVENTION

The present invention is directed to a lamp holder assembly which is designed to accommodate a wide range of lamps in order to establish a substantially universal, overall lighting system. That is, the lamp holder assembly of the invention directly accommodates the use of various lighting units, as well as one or more adapter bases designed for use in a multitude of international applications. More specifically, the universal lamp holder assembly of the invention can include an adapter base which, in certain preferred embodiments, incorporates snap connectors that enable latching of the adapter base to a housing or other support. In any event, a lamp holder member is snap-fittingly inserted into the adapter base and firmly maintained in place. With this arrangement, a single lamp holder member can be employed with various adapter bases or different lamp holder members can be used with common adapter bases to fit both domestic and a multitude of international hi-volt (e.g. 220–240V, 50/60 Hz) and 115 volt applications, as well as to provide requisite protection from electrical shocks.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
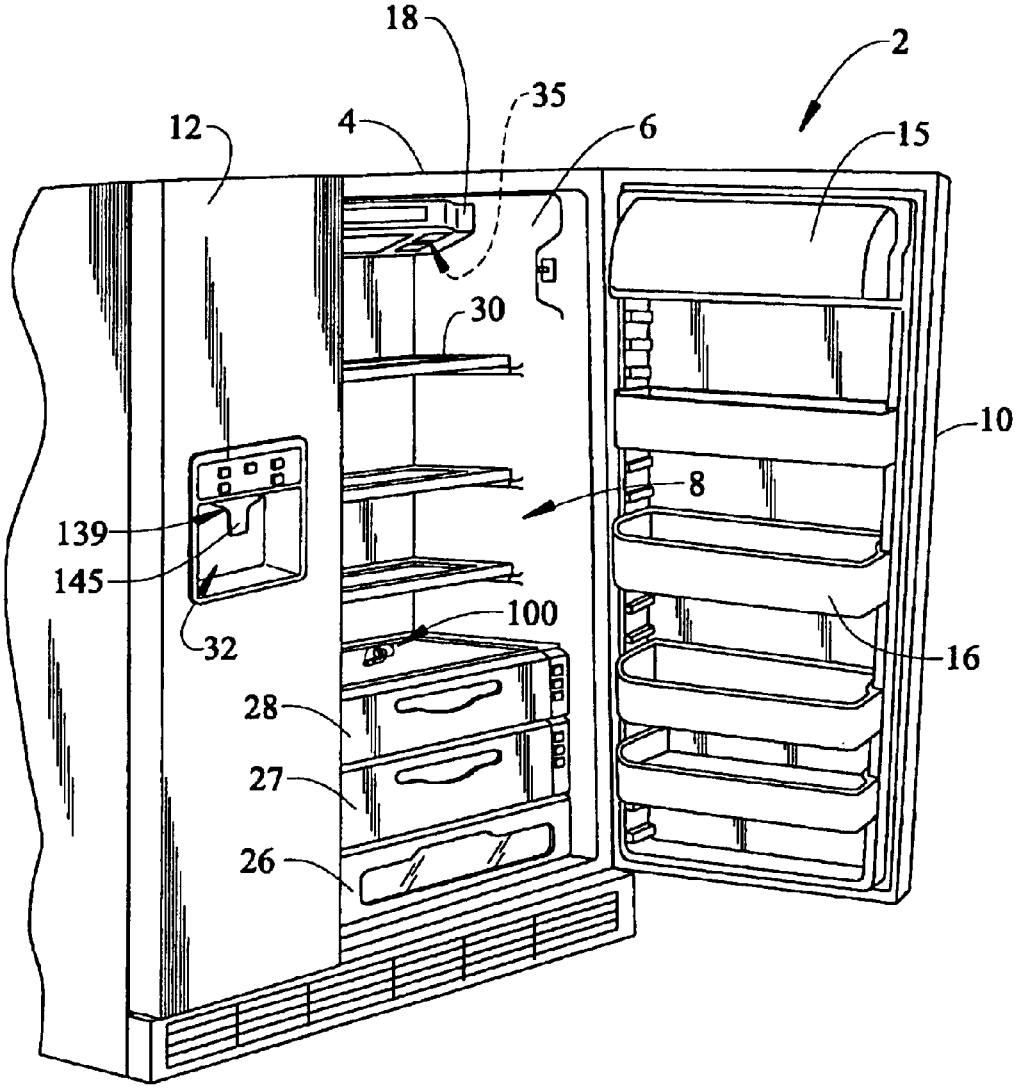
FIG. 1 is a perspective view of a side-by-side refrigerator incorporating universal lamp holder assemblies constructed in accordance with the invention.

With initial reference to FIG. 1, a side-by-side refrigerator 2 includes a cabinet shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a liner defined freezer compartment (not shown). For the sake of completeness, door 10 of refrigerator 2 is shown to include a dairy compartment 15 and various vertically adjustable shelving units, one of which is indicated at 16. Mounted in an upper region of fresh food compartment 8 is a temperature control housing 18 which, in a manner known in the art, can be used to regulate the temperature in both fresh food compartment 8 and the freezer compartment. At a lowermost portion of fresh food compartment 8 is provided various slidable bins, i.e., a lowermost bin 26 and higher bins 27 and 28 which may be individually temperature controlled. Supported in fresh food compartment 8 are a plurality of vertically spaced shelves 30. In freezer door 12 is arranged an ice and/or water dispenser which is generally indicated at 32.

To this point, the above-described structure is known in the art and presented only for the sake of completeness. For instance, this structure is actually more fully described in U.S. Pat. No. 6,170,276 which is herein incorporated by reference. The present invention is actually directed to the incorporation of one or more lamp holder assemblies, generally indicated at 35, 100 and 139, in refrigerator 2.

Figure 2:
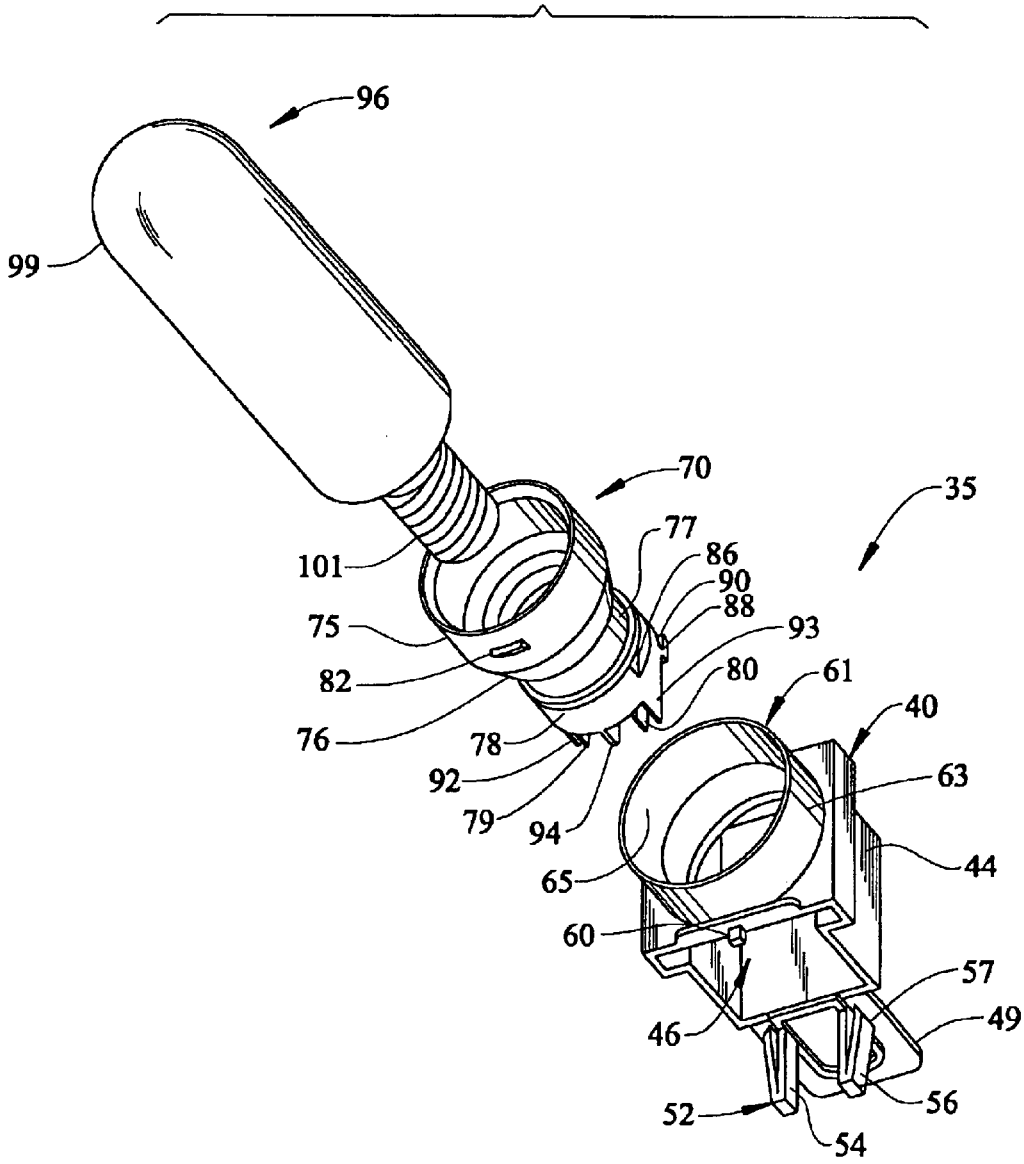
FIG. 2 is an exploded view of a lamp holder assembly constructed in accordance with a first preferred embodiment of the invention and employed in the refrigerator of FIG. 1.
Figure 3:
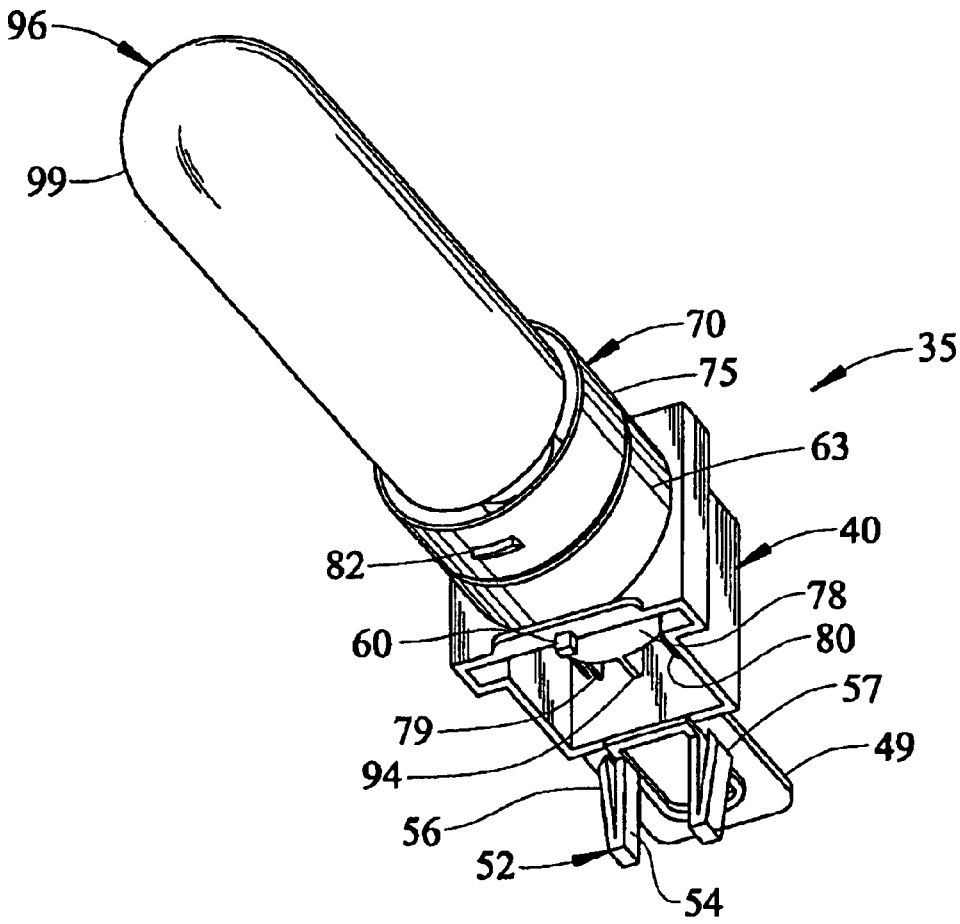
FIG. 3 is a perspective view of the lamp holder assembly of the first embodiment shown assembled.

Reference will now be made to FIGS. 2 and 3 in describing a preferred construction and mounting for lamp holder assembly 35, which represents a first preferred embodiment of the present invention. As shown, there is depicted a lamp holder assembly 35 constructed in accordance with a first preferred embodiment of the invention. Lampholder assembly 35 includes a lamp base in the form of a housing 40 including a main body portion 44 which defines an interior cavity 46. Extending from main body portion 44 is a rear flange 49 from which project a pair of flexible finger members, one of which is indicated at 52. Each finger member 52 includes first and second legs 54 and 56, with first leg 54 being cantilevered from rear flange 49 and second leg 56 defining a tapered, terminal end 57. Spaced from flexible finger members 52, main body portion 44 is provided with a locating projection 60.

Lamp housing 40 also includes a socket body portion 61 having a front peripheral portion 63 that defines an opening 65. Opening 65 is adapted to receive a lamp holder or socket member 70 which also forms part of lamp holder assembly 35. In the embodiment shown, lamp holder member 70 includes first, second, third and fourth sections 75–78, all of which are preferably, integrally formed of plastic. As will become more fully evident below, lamp holder member 70 incorporates requisite electrical connections, including prongs 79 and 80. In the most preferred embodiment, first section 75 of lamp holder member 70 is provided with a pair of opposing, circumferentially spaced outer nubs, one of which is indicated at 82. In general, each nub 82 constitutes a tapering projection which extends radially outwardly from first section 75. Although not shown, third section 77 is, in the preferred embodiment shown, internally threaded. On the other hand, fourth section 78 is preferably formed with a pair of opposing side slots, one of which is indicated at 86. Fourth section 78 is also provided with a rear, transversely extending and tapered catch member 88 which is spaced from the remainder of fourth section 78 by a transverse groove or channel 90. Furthermore, fourth section 78 includes side wall sections 92 and 93, as well as an electrical divider wall 94.

Lamp holder assembly 35 also includes a lamp module 96 including a bulb portion 99 and a base portion 101. In the most preferred form in the invention, base portion 101 is preferably, externally threaded in a manner known in the art. With this construction, lamp holder assembly 35 is adapted to be mounted within refrigerator 2 for use in connection with illuminating fresh food compartment 8. More specifically, lamp holder assembly 35 is snap-fittingly attached to a pre-defined portion of control housing 18 as indicated in FIG. 1, with locating projection 60 extending into an opening (not shown) and flexible finger members 52 being snap-fittingly received within mounting slots (also not shown but described more fully below) in order to fix lamp housing 40 in a desired location. As evidenced further below, catch member 88 is further snap-fittingly engaged with structure of lamp housing 40 in interior cavity 46. Lamp housing 40 is adapted for use in connection with lamp 96 and, in accordance with the present invention, can take additional forms or used in combination with one or more adapter bases, as will be more fully described below, in order to provide a generally universal lamp holder arrangement employing lamp holder 70.

Figure 4:
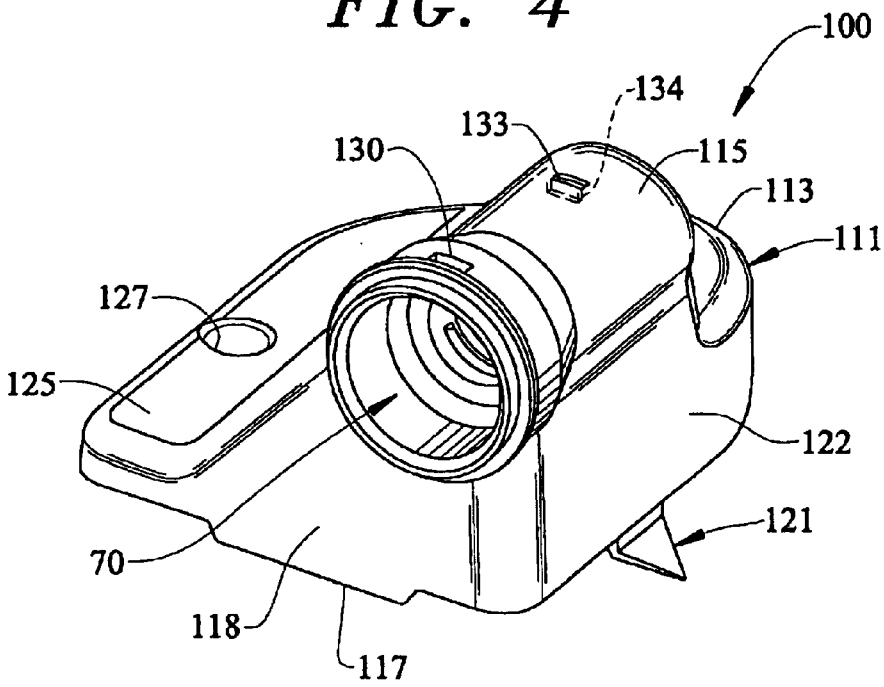
FIG. 4 is a perspective view of a lamp holder assembly constructed in accordance with a second preferred embodiment of the invention and employed in the refrigerator of FIG. 1.
Figure 5:
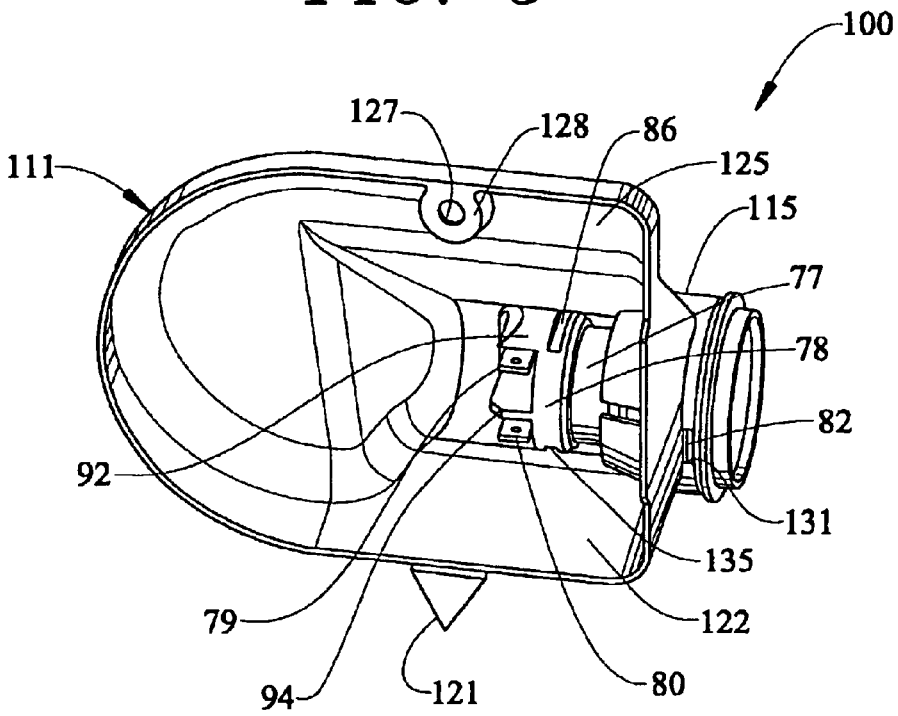
FIG. 5 is a bottom perspective view of the lamp holder assembly of FIG. 4.

Additional advantageous features of the overall lamp holder arrangement of the invention will become more fully evident below in initially describing further embodiments of the invention. To this end, FIGS. 4 and 5 disclose an additional lamp holder assembly 100 in accordance with the present invention including an adapter base in the form of a lamp housing 111 which has a main body portion 113 and a socket body portion 115. Although lamp housing 111 can be employed in various fashions in accordance with the present invention, this embodiment is particularly adapted for use in connection with illuminating one or more refrigerated areas at bins 26–28 (see FIG. 1). In any event, as shown, main body portion 113 preferably includes a frontal tab 117 formed in a front wall 118, as well as a locating projection 121 extending from a side wall 122. Furthermore, main body portion 113 includes a ledge portion 125 provided with an opening 127 which is defined by reinforcing boss 128. On the other hand, socket body portion 115 is shown to include a pair of opposing slots 130 and 131, as well as a rear slot 133. Rear slot 133 defines an internal, inwardly projecting radial retainer member in the form of a rib illustrated at 134. Finally, an inwardly projecting side retainer member 135 is provided within socket body portion 115.

Lamp housing 111 is adapted to be utilized in combination with lamp holder member 70 and lamp 96 in a manner analogous to that of lamp housing 40 of the first embodiment. As illustrated in these figures, lamp holder member 70 has been inserted into socket body portion 115, with nubs 82 being snap-fittingly received within slots 130 and 131, catch member 88 being interengaged with retainer member 134, and retainer member 135 being received within a respective side slot 86. In this manner, lamp holder member 70 is fixedly secured within lamp housing 111 in a snap-fit manner. As clearly illustrated in FIG. 5, lamp holder member 70 is mounted so as to expose the pair of spaced electrical prongs 79 and 80 which are completely encompassed by main body portion 113.

In accordance with the most preferred form of the invention, lamp housing 111 is adapted to be mounted within refrigerator 2 by slipping locating projection 121 within a slot, such as formed in liner 6, and then pivoting lamp housing 111 until frontal tab 117 becomes arranged in another slot, whereupon a mechanical fastener, such as a screw, can be inserted into opening 127 and threaded into liner 6 in order to fixedly secure lamp housing 111 in a desired position. At this point, it should be readily recognized that lamp housing 111 could be utilized in various positions within refrigerator 2, including both fresh food compartment 8 and the freezer compartment (not shown), but again is particularly adapted for use in connection with establishing a crisper light, such as in connection with one or more bins 26–28 as generally illustrated in FIG. 1. It should also be recognized that lamp housing 111 could be adapted to receive differently configured lamp holder members. That is, lamp holder member 70 is snap-fit into lamp housing 111 in order to receive lamp 96 or variations thereof (e.g. varying shape or wattage bulbs), but in other environments of use, such as select foreign countries, lamp housing 111 may be required to receive a different type of lamp module and, correspondingly, a different lamp holder member.

Figure 6:
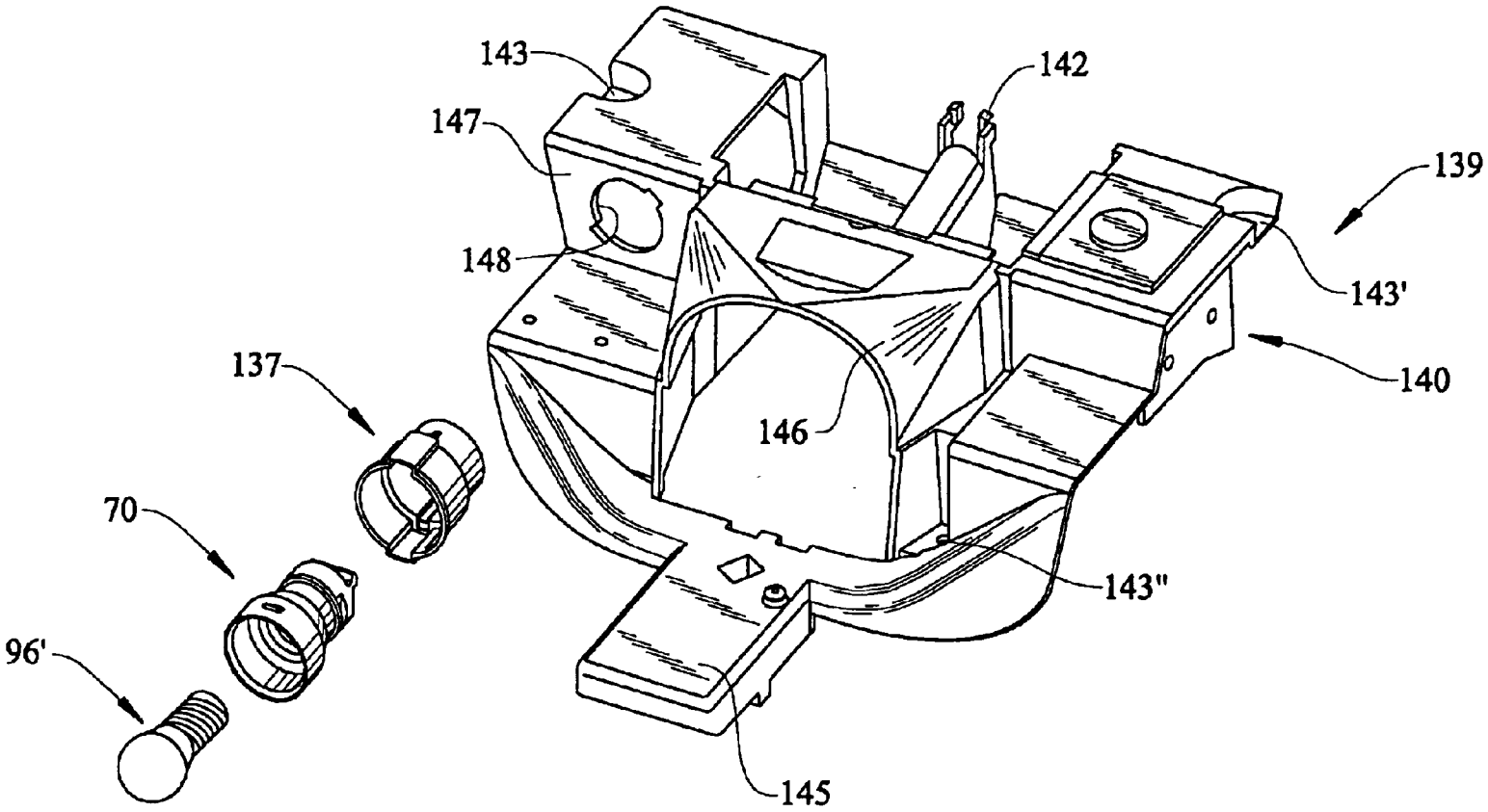
FIG. 6 is an exploded view of a refrigerator dispenser housing employed in the refrigerator of FIG. 1, in combination with lamp holder assembly constructed in accordance with a third embodiment of the invention.
Figure 7:
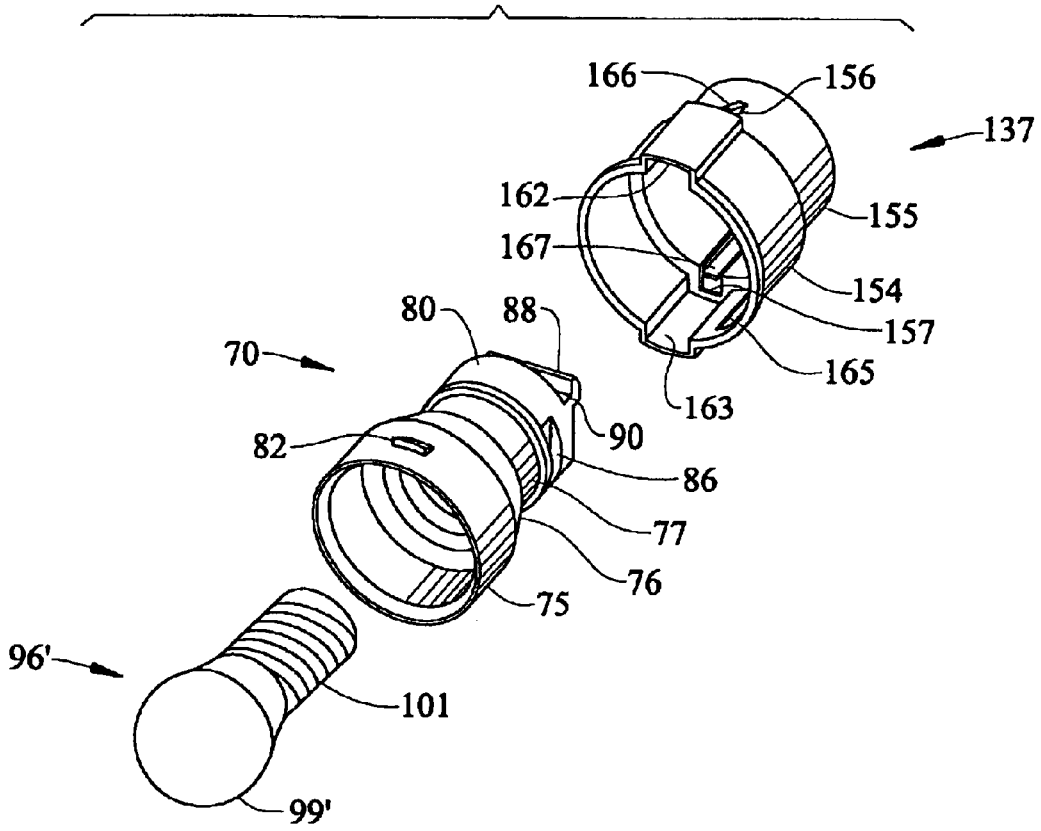
FIG. 7 is an exploded view of the lamp holder assembly of FIG. 6.
Figure 8:
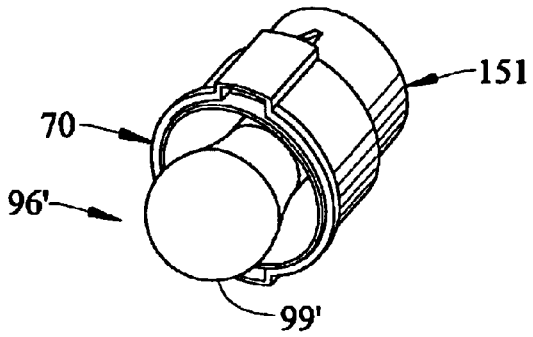
FIG. 8 depicts the lamp holder assembly of FIG. 6 assembled outside of the refrigerator dispenser housing of FIG. 6.

To accommodate different mounting and lamp requirements, the overall lamp holder assembly of the invention can incorporate other adapter bases, one of which is indicated at 137 in FIGS. 6–8. With initial reference to FIG. 6, adapter base 137, in combination with lamp holder member 70 used to support a lamp 96', forms part of an overall dispenser assembly 139 for dispenser 32 of FIG. 1. As shown in FIG. 6, dispenser assembly 139 includes a housing 140. Although the particular construction and mounting of housing 140 can greatly vary in accordance with the present invention, the most preferred embodiment employs the use of clips 142 to mount a control board (not shown), as well as mechanical fasteners for mounting housing 140 to freezer door 12 at recessed mounting locations 143, 143' and 143". In any event, at this point, it is merely important to note that housing 140 includes a container sensing panel 145, a chute portion 146, and at least one plate portion 147 which defines a slotted opening 148.

As shown best in FIG. 7, adapter base 137 includes a first diametric body portion 154 and a second diametric body portion 155. Adapter base 137 is provided with opposing, elongated cutouts 156 and 157, as well as opposing channels 162 and 163. Adjacent channels 162 and 163 are provided opposing elongated slots, one of which is indicated at 165. Channels 162 and 163 aid in providing opposing resilient finger members or clips 166 and 167 at diametric opposing portions of second diametric body portion 155. Finger members 166 and 167 are cantilevered from second diametric body portion 155 and project into first diametric body portion 154. This arrangement enables adapter base 137 to be snap-fittingly received in a slotted opening 148 associated with housing 140. On the other hand, lamp holder member 70 is then snap-fittingly mounted in adapter base 137, with each projection or nub 82 being received in a respective slot 165. Although FIG. 8 depicts lamp holder member 70 assembled with adapter base 137, in the most preferred form in the invention, the overall assembly is performed by mounting housing 140 at dispenser 32, snap-fittingly attaching adapter base 137 to housing 140, snapping lamp holder member 70 into adapter base 137, and then threadably attaching lamp 96'.

Figure 9:
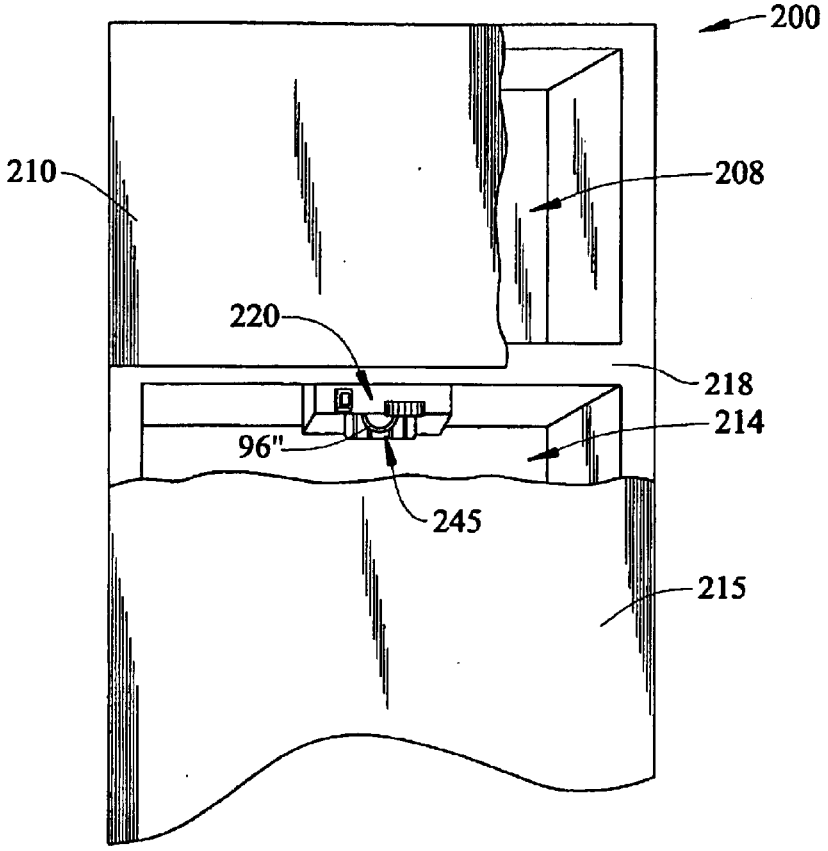
FIG. 9 is a perspective view of a top mount refrigerator incorporating a lamp holder assembly constructed in accordance with a fourth embodiment of the invention.

The overall invention can also be utilized in connection with other appliances, including a top mount refrigerator as indicated at 200 in FIG. 9. In a manner known in the art, top mount refrigerator 200 includes a freezer compartment 208 having an associated door 210, as well as fresh food compartment 214 having a door 215. Freezer and fresh food compartments 208 and 214 are separated by a mullion 218. Located in an upper portion of fresh food compartment 214 is a control housing 220 which is shown in FIG. 9 to support a lamp 96".

Figure 10:
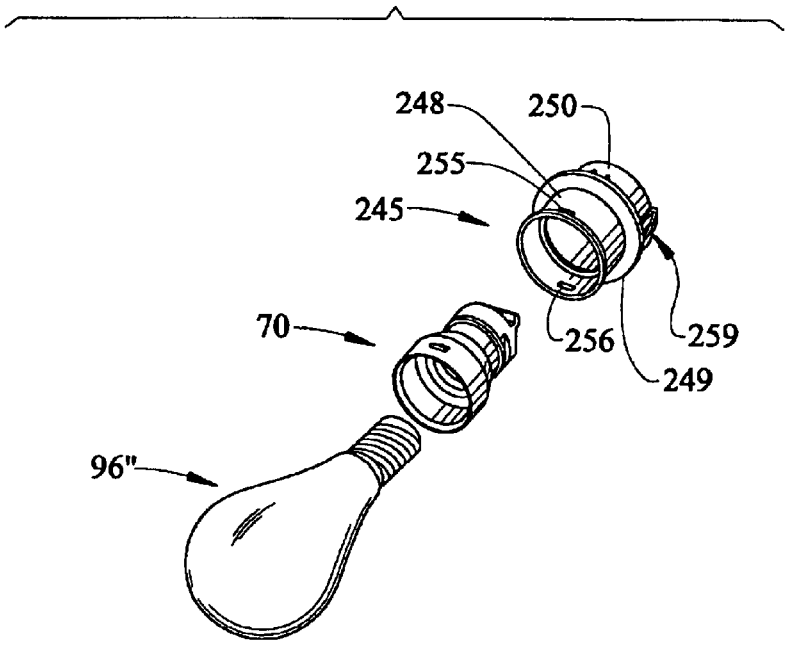
FIG. 10 is an exploded view of the lamp holder assembly of FIG. 9.

In connection with this form of the invention, an overall lamp holder assembly includes an adapter base 245 which is shown in FIG. 10 to include first, second and third diametric portions 248–250. Most preferably, first diametric portion 248 is formed with a pair of opposing slots 255 and 256. Second diametric portion 249 has a diameter which is greater than either of first and second diametric portions 248 or 250 and, preferably, has a reduced axial dimension. On the other hand, third diametric portion 250 is provided with a pair of opposed, flexible finger members, one of which is indicated at 259. In general, finger members 259 are constructed in a manner directly corresponding to each of finger members 52 as described above.

With this construction, adapter base 245 can be snap-fit into a slotted opening (not shown but corresponding to slotted opening 148 of FIG. 6), with third diametric portion extending into the opening and finger members 259 extending through a respective plate portion (not shown) to fix adapter base 245 in position, with second diametric portion 249 being received against the plate portion. Thereafter, lamp holder member 70 can be snap-fit into adapter base 245, with nubs 82 being received within slots 255 and 256. Finally, lamp 96" can be threaded or otherwise secured in position within lamp holder member 70.

Based on the above description, it should be readily apparent that lamp holder member 70 can be directly mounted within a housing base 111 or used in combination with one or more adapter bases 137, 245 in order to accommodate the use of various lighting units in a multitude of domestic and international applications. Each of adapter bases 137 and 245 is preferably provided with snap connectors which enable latching of these adapter bases to respective housing portions in a quick and easy manner. In any case, the lamp holder member can be inserted into the respective adapter base and firmly locked in place through one or more snap connections.

The above description provides reference to the use of lamp holder member 70 and an associated lamp 96, 96' and 96" in connection with illuminating fresh food compartment 8 in general, one or more crisper or other bins 26–28, dispenser 32 of side-by-side refrigerator 2, and/or fresh food compartment 214 of top mount refrigerator 200. This description has been set forth to clearly illustrate the potential mounting in connection with a temperature control housing, liner walls, crisper bins and/or dispenser structure in order to illustrate the versatile and overall universal assembly which provides for both domestic and a multitude of international hi-volt (e.g. 220–240V, 50/60 Hz) and 115 volt applications, while assuring that all electrical connections are covered to assure protection against potential electrical shocks. In addition providing a range of adapter bases to suit particular uses, different lamp holder members can also be utilized. That is, lamp holder member 70 is preferably designed to accommodate a lamp module with an Edison-type screw base, but the lamp holder could be designed to enable attachment of other known lamp modules/bulbs as well, including those requiring bayonet-type mountings.

In this manner, another aspect of the present invention is to enable differently configured lamp holder members to be used in combination with one or more of the adapter bases, whether in the form of a base housing as disclosed in connection with the embodiments of FIGS. 2–5 or essentially rings as disclosed in connection with the embodiments of FIGS. 6–10, to cover the overall gambit of domestic and international applications. Obviously, it is not feasible to represent all the possible variations for the lamp holder member, but rather it is simply important to note that the lamp holder member 70 employs three distinct sets of snap connection elements, i.e., nubs 82, slots 86 and catch member 88, such that any particular lamp holder member for a specific application need only include one or more of these snap structures in order to be readily used in combination with one or more of the adapter bases in accordance with the present invention. Therefore, lamp holder member 70 in accordance with the present invention is designed for use in at least the four illustrated illumination zones presented in the figures of this application. Lamp holder member 70 is specifically designed to accommodate a wide range of lamps of the Edison type used almost universally in domestic appliances and also in certain international applications. In other applications wherein plug-in or bayonet-type lamps are employed, the base adapters of the present invention can still be utilized, but with a suitable lamp holder member employing one or more of the requisite sets of snap connector elements.

Even with the description of various preferred embodiments, it should be still recognized that various changes, and/or modifications can still be made to the invention without department from the spirit thereof. For instance, the freezer compartment can readily be provided with a corresponding lamp holder assembly, such as by mounting lamp housing 40 directly to the liner defining the freezer compartment. In general, the invention is only intended to be limited by the scope of the following claims.

We claim:

1. A domestic appliance comprising:

a cabinet shell;

a liner mounted within the cabinet shell and defining an interior compartment;

a door pivotally mounted for movement relative to the cabinet shell in order to selectively access the interior compartment;

a housing element attached to one of the door and the liner; and a lighting assembly for illuminating at least one of the interior compartment and an exterior portion of the appliance, said lighting assembly including:

a base member fixedly secured relative to the one of the door and the liner through the housing element, said base member being configured to only indirectly receive a lamp to be illuminated;

a lamp holder member snap-fittingly connected to the base member, said lamp holder member defining a socket; and a lamp received within the socket of the lamp holder member.

2. The domestic appliance according to claim 1, wherein the lamp holder member incorporates a pair of electrical prongs, said lamp holder member being integrally formed with a dividing wall arranged between the electrical prongs.

3. The domestic appliance according to claim 1, wherein the lamp holder member includes first and second sets of spaced, distinct snap-fit connector elements.

4. The domestic appliance according to claim 3, wherein the first set of snap-fit connector elements constitutes plural nub members provided on a frontal portion of the lamp holder member.

5. The domestic appliance according to claim 4, wherein the second set of snap-fit connection elements constitutes a tapered catch member.

6. The domestic appliance according to claim 5, wherein the lamp holder member includes a rear section, said catch member being spaced from the rear section by a transverse groove.

7. The domestic appliance according to claim 5, further comprising a third set of distinct snap-fit connector elements provided on the lamp holder member.

8. The domestic appliance according to claim 7, wherein the third set of snap-fit connector elements constitutes side slots formed in the lamp holder member.

9. The domestic appliance according to claim 1, wherein the base member comprises an adapter configured to receive the lamp holder member.

10. The domestic appliance according to claim 9, wherein the adapter is provided with a pair of opposing, elongated cut-outs at which the lamp holder member snap-fittingly connected.

11. The domestic appliance according to claim 9, wherein the adapter is formed with a pair of resilient finger members snap-fittingly fixing the base member at the exterior portion of the appliance.

12. The domestic appliance according to claim 9, wherein the base member constitutes an adapter housing.

13. The domestic appliance according to claim 12, wherein the housing is further provided with a locating projection spaced from the finger members.

14. The domestic appliance according to claim 12, wherein the housing is provided with a pair of flexible finger members for snap-connecting the housing in a fixed position within the interior compartment.

15. The domestic appliance according to claim 14, wherein each of the finger members includes first and second legs, with the first leg being cantilevered from the housing and a second leg defining a tapered, terminal end.

16. The domestic appliance according to claim 15, wherein the housing includes a rear flange, said finger members being directly supported by the rear flange.

17. The domestic appliance according to claim 12, wherein the domestic appliance further comprises a temperature control housing mounted within the interior compartment, said adapter housing being snap-fittingly connected to the temperature control housing.

18. The domestic appliance according to claim 17, wherein the domestic appliance comprises a side-by-side refrigerator.

19. The domestic appliance according to claim 9, wherein the adapter comprises at least first, second and third diametric sections, with the second diametric section being interposed between and having an associated larger diameter than the first and second sections, said third section including snap-fit connectors for securing the adapter within the interior compartment.

20. The domestic appliance according to claim 19, wherein the snap-fit connectors constitute a pair of flexible finger members for snap-connecting the housing in a fixed position within the interior compartment.

21. The domestic appliance according to claim 20, wherein the housing element comprises a temperature control housing mounted within the interior compartment, said adapter housing being snap-fittingly connected to the temperature control housing.

22. The domestic appliance according to claim 21, wherein the domestic appliance comprises a top-mount style refrigerator.

23. The domestic appliance according to claim 9, wherein the housing element is provided with an opening, said housing element being fixedly secured to the door, said adapter being attached to the housing element.

24. The domestic appliance according to claim 23, wherein the opening comprises a slotted opening which snap-fittingly receives the adapter.

25. The domestic appliance according to claim 23, wherein the housing element defines a dispenser housing, at least a portion of which is exposed at the exterior portion of the appliance.

26. The domestic appliance according to claim 1, wherein the domestic appliance comprises a refrigerator.

27. The domestic appliance according to claim 26, wherein the housing element constitutes a temperature control housing mounted within the interior compartment, said base member being snap-fit to the temperature control housing.

28. The domestic appliance according to claim 27, further comprising a dispenser housing mounted in the door, a second base member, a second lamp holder snap-fittingly connected to the second base member, and a second lamp received within the second lamp holder, said second base member being snap-fit to the dispenser housing.

29. The domestic appliance according to claim 28, further comprising at least one storage bin slidably supported within the interior compartment, said lighting assembly further including a third base member, a third lamp holder snap-fittingly connected to the third base member, and a third lamp received within the third lamp holder, said third base member being mounted at the bin to enable the third lamp to illuminate a storage area associated with the bin.

30. The domestic appliance according to claim 29, wherein the first, second and third base members are distinctly configured relative to one another and the first, second and third lamp holders are identically constructed.

31. A domestic appliance comprising:

a cabinet shell;

a liner mounted within the cabinet shell and defining an interior compartment;

a door pivotally mounted for movement relative to the cabinet shell in order to selectively access the interior compartment; and a lighting assembly for illuminating at least one of the interior compartment and an exterior portion of the appliance, said lighting assembly including:

a base member fixedly secured relative to the one of the door and the liner, wherein the base member constitutes an adapter housing which is configured to only indirectly receive a lamp to be illuminated, wherein the adapter housing includes a main body portion and a socket portion, wherein the main body portion further includes a tab for orienting the adapter housing within the interior compartment;

a lamp holder member, said lamp holder member being snap-fittingly connected within the socket portion of the base member, said lamp holder member defining a socket; and a lamp received within the socket of the lamp holder member.

32. The domestic appliance according to claim 31, wherein the main body portion is provided with a locating projection and is also formed with a reinforcing boss having an associated opening adapted to receive a mechanical fastener for securing the adapter housing within the interior compartment.

33. The domestic appliance according to claim 31, wherein the domestic appliance further includes a bin slidably mounted within the interior compartment, said adapter housing being positioned to directly illuminate a storage compartment associated with the bin.

34. The domestic appliance according to claim 31, wherein the adapter housing is formed with first and second sets of distinct snap-fit connector elements for snap-fittingly receiving the lamp holder member.

35. The domestic appliance according to claim 34, further comprising a third set of snap-fit connector elements provided on the adapter housing, said lamp holder member being inter-engaged with the third set of snap-fit connector elements.

36. A method of illuminating various regions of a domestic appliance having an interior compartment selectively closed off by a pivotable door comprising:

mounting at least first and second, distinctly configured adapter bases in two of the various regions respectively;

snap-fittingly connecting identically constructed lamp holder members in the first and second adapter bases respectively; and mounting lamps in the lamp holder members.

37. The method of claim 36 further comprising:

mounting a third adapter base, which is configured distinct from each of the first and second adapter bases, in a third of the various regions;

mounting another, identically constructed lamp holder member in the third adapter base; and mounting a lamp in the another lamp holder.

38. The method of claim 37, wherein the first adapter base is mounted to a temperature control housing within the interior compartment of the appliance.

39. The method of claim 38, wherein the second adapter base is mounted to a housing of a dispenser provided in the pivotable door.

40. The method of claim 39, wherein the third adapter base is mounted at a position to directly illuminate a slidable storage bin mounted in the interior compartment.

* * * * *